US011542638B2

(12) United States Patent
Di Stefano et al.

(10) Patent No.: US 11,542,638 B2
(45) Date of Patent: Jan. 3, 2023

(54) PROCESS FOR THE PRODUCTION OF A WOVEN TAPE FOR ZIPPERS WITH WEFT EFFECT FOR THE CUSTOMIZATION AND IDENTIFICATION OF A BRAND

(71) Applicant: ETIGROUP S.P.A., Sant'Omero (IT)

(72) Inventors: Eraldo Di Stefano, Ascoli Piceno (IT); Roberta Di Stefano, Ascoli Piceno (IT)

( * ) Notice: Subject to any disclaimer, the term of this patent is extended or adjusted under 35 U.S.C. 154(b) by 270 days.

(21) Appl. No.: 16/771,160

(22) PCT Filed: Dec. 21, 2018

(86) PCT No.: PCT/EP2018/025332
§ 371 (c)(1),
(2) Date: Jun. 9, 2020

(87) PCT Pub. No.: WO2019/129382
PCT Pub. Date: Jul. 4, 2019

(65) Prior Publication Data

US 2021/0172097 A1 Jun. 10, 2021

(30) Foreign Application Priority Data

Dec. 29, 2017 (IT) ..... 102017000151308
Oct. 7, 2018 (IT) ..... 102018000007086

(51) Int. Cl.

| | |
|---|---|
| ***D03D 1/00*** | (2006.01) |
| ***D03D 3/00*** | (2006.01) |
| ***A44B 19/34*** | (2006.01) |
| ***D03D 11/02*** | (2006.01) |
| *D03D 47/38* | (2006.01) |

(52) U.S. Cl.
CPC ..... *D03D 3/005* (2013.01); *A44B 19/346* (2013.01); *D03D 1/00* (2013.01); *D03D 11/02* (2013.01); *D10B 2501/0631* (2013.01)

(58) Field of Classification Search
CPC ..... D03D 3/005; D03D 1/00; D03D 11/02; D03D 35/00; A44B 19/346; D10B 2501/0631
See application file for complete search history.

(56) References Cited

U.S. PATENT DOCUMENTS

| | | | | |
|---|---|---|---|---|
| 302,925 A * | 8/1884 | Miehling | ..... | B65H 59/04 242/156 |
| 2,424,411 A * | 7/1947 | Moore | ..... | D03D 35/00 139/384 R |
| 5,020,206 A * | 6/1991 | Yoshida | ..... | A44B 19/42 29/408 |

(Continued)

FOREIGN PATENT DOCUMENTS

FR 2427804 A1 1/1980

OTHER PUBLICATIONS

International Search Report for corresponding PCT/EP2018/025332.
Written Opinion of the ISA for corresponding PCT/EP2018/025332.

*Primary Examiner* — Robert H Muromoto, Jr.
(74) *Attorney, Agent, or Firm* — Egbert, McDaniel & Swartz, PLLC

(57) ABSTRACT

In the sector of the production of customized zipper tapes for application on items of apparel and accessories, disclosed is a process for the production of a woven tape with weft effect using a jacquard loom which permits control of each thread of the weft, warp and cord so that the design is not subject to limitations of repetition and length.

5 Claims, 12 Drawing Sheets

(56) References Cited

U.S. PATENT DOCUMENTS

| | | | | | |
|---|---|---|---|---|---|
| 5,983,465 | A * | 11/1999 | Wakai | A44B 19/40 | 24/392 |
| 6,047,404 | A * | 4/2000 | Blanks, I | A41D 15/005 | 2/108 |
| 6,105,284 | A * | 8/2000 | Wu | A44B 19/343 | 66/202 |
| 7,841,369 | B1 * | 11/2010 | Osborne | A41D 13/0012 | 139/390 |
| 2020/0157721 | A1 * | 5/2020 | Garcia | D05B 35/062 | |

* cited by examiner

PROCESS FOR THE PRODUCTION OF A WOVEN TAPE FOR ZIPPERS WITH WEFT EFFECT FOR THE CUSTOMIZATION AND IDENTIFICATION OF A BRAND

FIELD OF INVENTION

This invention concerns the sector of the production of customized zipper tapes for application on items of apparel and accessories, and specifically a process for the production of a woven tape with weft effect using a jacquard loom which permits control of each thread of the weft, warp and cord so that the design is not subject to limitations of repetition and length.

BACKGROUND OF THE INVENTION

According to the current state of the art it is known that zippers are systems of closure composed of two tapes of warp effect fabric on which nylon, metal or plastic teeth are fastened by means of cords and staggered in such a way as to fit together in a dovetail one on the other. These zippers are also equipped with a pull that serves to couple or separate said teeth.

The demands of fashion require that even zippers, which were used to be merely functional elements of apparel, must now be also and above all decorative, with patterns, woven or printed, representing a frieze, motif, a band of words or numerals, or whatever else is in style at the moment.

Until now, the tapes on which the typical zipper teeth are fastened were woven on looms that produced a warp effect, where it is possible to create a single weave by means of a closed pick, and the design is limited by the number of heddles or heddle frames, so that the design visible on the tape was created by the warp threads (which run longitudinally, parallel to the direction of output of the tape) interlacing with the weft threads (perpendicular to the direction of output of the tape). Thus any design on the tape is created prevalently by the warp threads.

According to the current state of the art, it is also known that there are tapes, woven such as those described above, with warp effect, on which a more or less well-defined image can be printed. The tape obtained, however, is a woven tape with a printed design and not a tape with the design woven into it, so that the quality of the design, from the esthetic standpoint, is inferior in sharpness and precision to the one woven into the fabric.

According to the current state of the art, other woven tapes are known, produced on jacquard looms with weft effect, but which have never been used or usable for zippers, in which the design motif is created mainly by the weft thread that are, in turn, interlaced with the warp threads.

These woven tapes have many uses in apparel, including:

- cut as labels to identify a brand;
- as inserts in the plackets of polo shirts, on the sleeves or sides;
- on trousers, mainly to line the waistband;
- as sweatbands applied to jerseys/shirts.

At the present time, the only tapes used in the production of zippers are those with warp effect, that is, with a single weft in which the level of definition of the design is not very high and on which it is not possible to obtain an image produced in a wide range of colours, as this is incompatible with the production process.

According to the current state of the art in the sector of woven tapes the following documents are known:

- U.S. Pat. No. 2,424,411 A, which discloses a method optimized for the production of a non-elastic narrow curved tape with controlled curvature, and the relative product. Regulation of the unrolling of a small beam (30) containing a cord (C) is managed by a clutch device (32) that creates friction on the beam by means of a weight connected to it.
- U.S. Pat. No. 5,020,206 A, which discloses a method for producing a gliding chain of fastening elements including a pair of continuous tapes having their respective models paired between them, and two rows of continuous fastening elements mounted along the longitudinal internal edges.
- FR 2 427 804 A1, which discloses a strip of fastening tape for zippers and the relative procedure for its manufacture.
- U.S. Pat. No. 5,983,465 A, which discloses:
  - a coloured fastening tape and
  - a fastening cross piece which has an ornamental portion running along an internal longitudinal border and is formed by multicoloured warp threads.

These documents all disclose fabric tapes for zippers woven with warp effect and that can have designs woven only with the warp threads interlaced with a single weft colour and with limits from the graphic standpoint.

Moreover, until now it was not possible to produce a woven tape with weft effect provided with a cord for fastening teeth and thus forming a zipper element.

DISCLOSURE OF THE INVENTION

The purpose of this invention is to present a process for the production of a zipper with weft effect for zippers woven on a jacquard loom with weft effect, that is, with the possibility of inserting different colours in the weft.

Another purpose of this invention is to present a process for the production of a tape woven with a jacquard loom with weft effect in which the definition of the design is greater than that obtainable in a tape woven with warp effect, as the density of weft threads per centimeter is greater than in a zipper tape known to the current state of the art.

Not last, a further scope of this invention is to present a zipper tape woven on a jacquard loom that permits a customization of the product, such as the insertion as a design in the zipper tape of a trademark or logo identical to that of a woven label and, in any case, identifying the brand.

These and other purposes are achieved by this invention, which concerns a process for the production of a zipper tape woven on a jacquard loom with weft effect.

Additional characteristics and advantages of the invention will be clearer from the description of a preferred, but not exclusive, embodiment of the procedure that is the subject of this patent application, illustrated for informative purposes, but without limitation, in the drawings included hereunder:

the cord (2);

the small added beam (3), positioned in front of the main beam (4) and supported by a rod (s) fastened to the uprights (k) of the jacquard loom;

a heddle (c);

a jacquard (e);

a reed (g);

a cloth roll (b).

Figure 10:
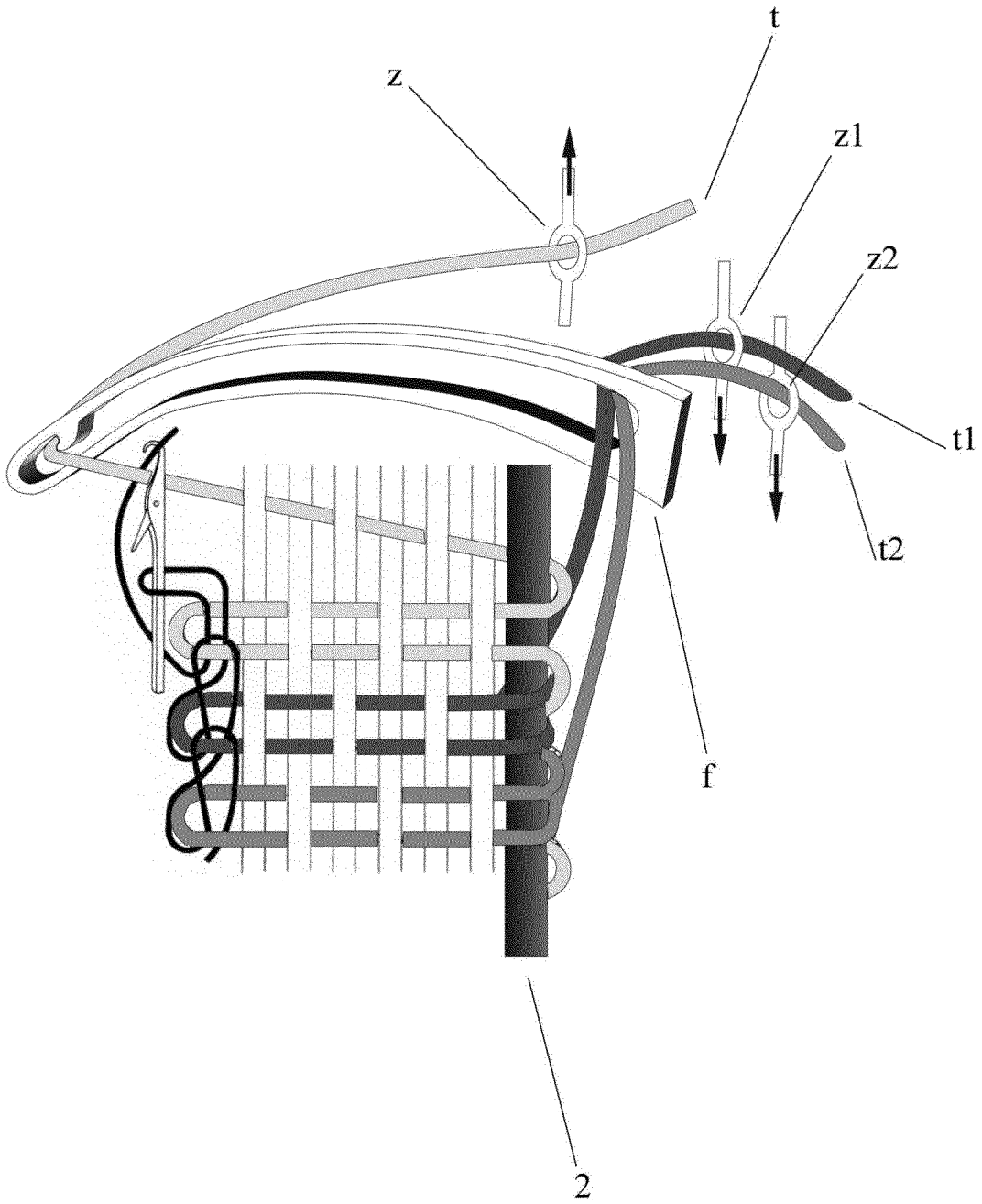
Figure 11:
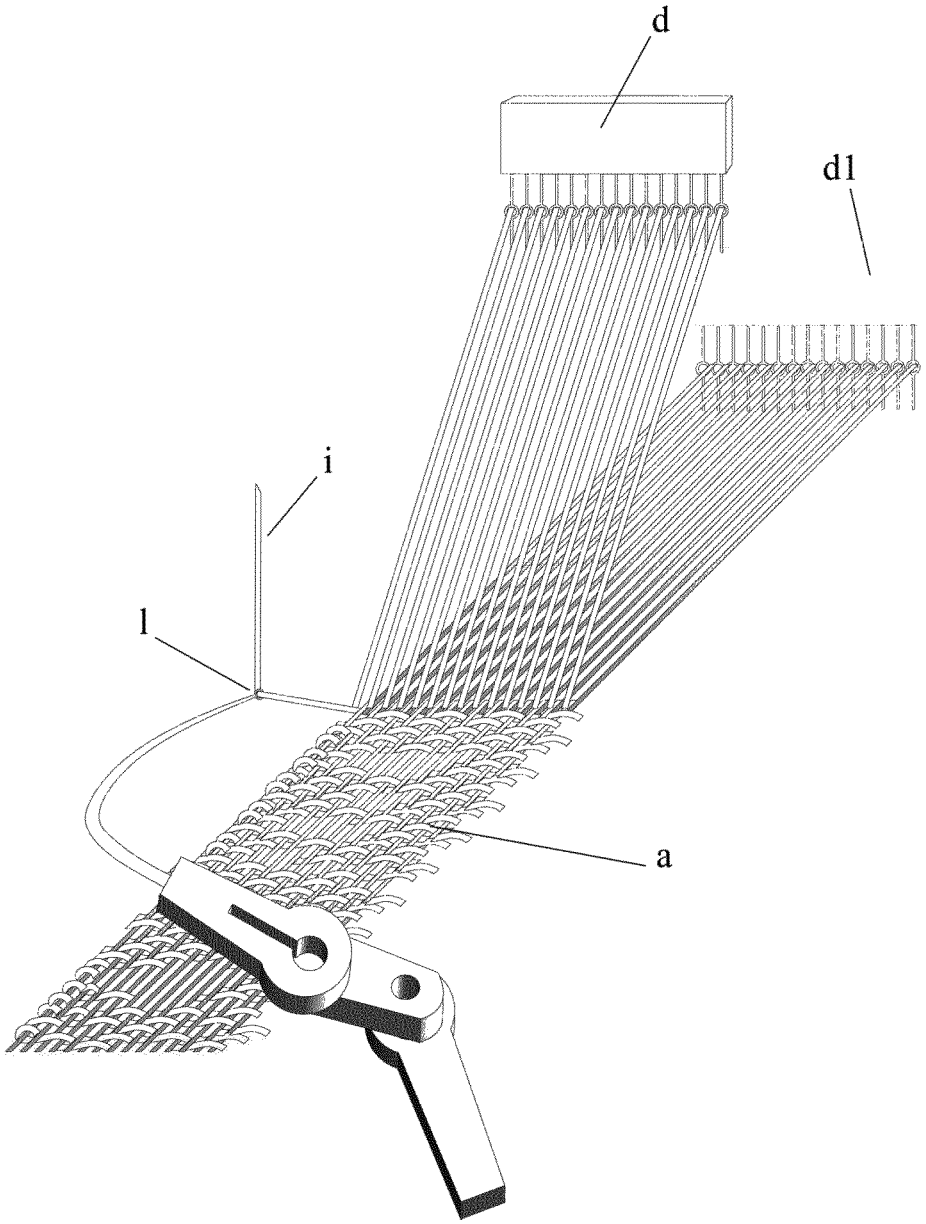

FIG. 10 shows a weaving system for zipper tapes with weft effect with multicoloured weft arrangement where a weft thread (t) to be woven into the tape is raised by a heddle rod (z) and caught by an open pick (f) that inserts it into the tape, while the wefts (t1) and (t2) are not selected as not involved in the creation of the design in that section of tape and are therefore drawn downward by the heddle eyes (z1) and (z2);

FIG. 11 shows the weaving system for a tape with warp effect (a) known according to the current state of the art, with a closed head in which the heddles (d) and (d1) can process the warp on the sole basis of their number and where a closed pick (1) permits insertion of a single weft thread (i).

Figure 12:
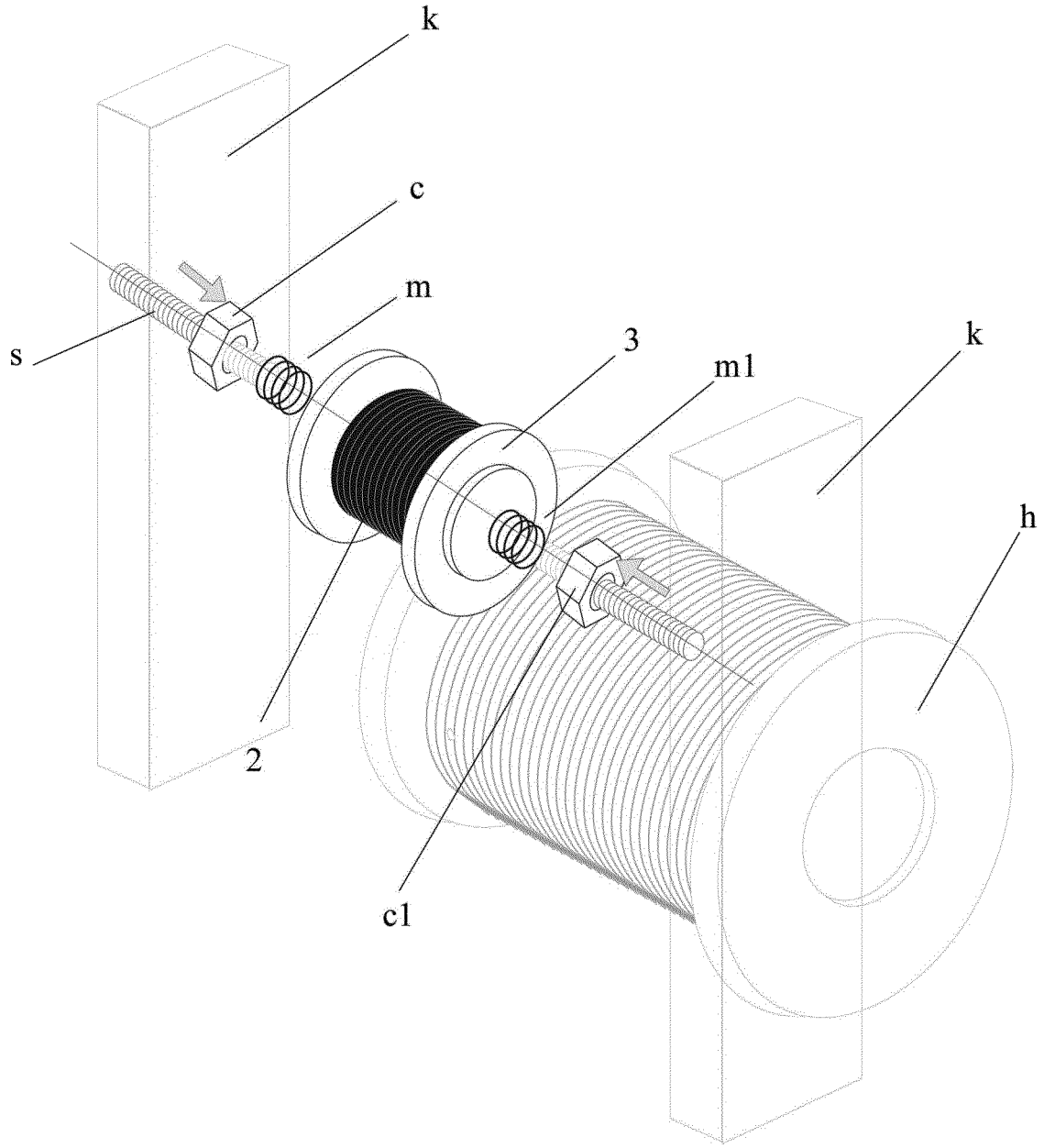

FIG. 12 shows the new system of adjustment of the small beam (3) added to weave a zipper taper with weft effect containing the cord (2), where the quantity of cord (2) is regulated by the pressure that two springs (m) and (ml) apply to said small beam (3) and where the intensity of the pressure can be controlled by screws (c) and (c1).

DETAILED DESCRIPTION OF THE INVENTION

According to a preferred—but not limiting—embodiment, this invention concerns a process for the production of a zipper tape woven on a jacquard loom with weft effect (1).

Figure 5:
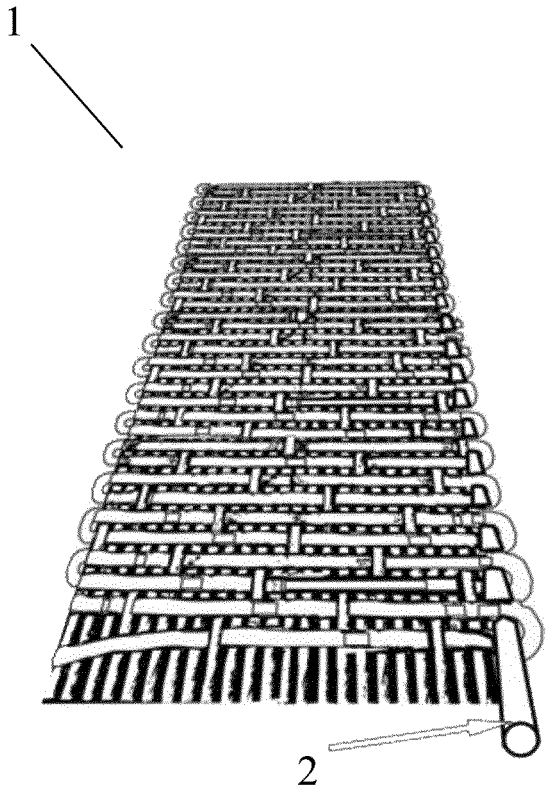
FIG. 5 shows a tape woven on a jacquard loom with weft effect (1) according to this invention, equipped with a cord (2) to permit the teeth (not shown) to grip said tape (1)
Figure 6:
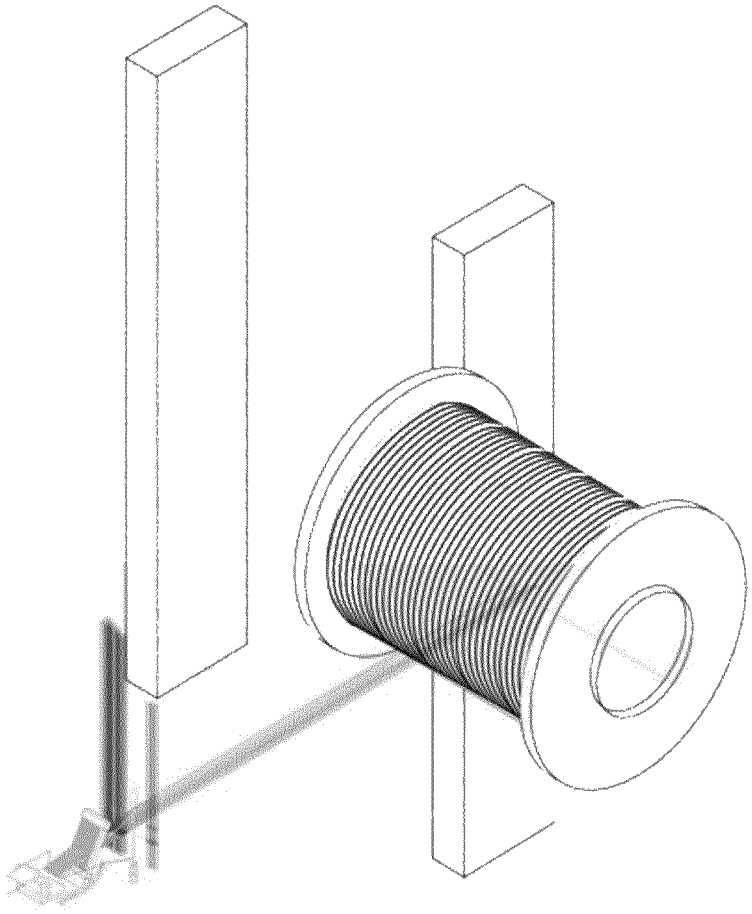
FIG. 6 shows a three-dimensional view of a loom known according to the current state of the art.
Figure 7:
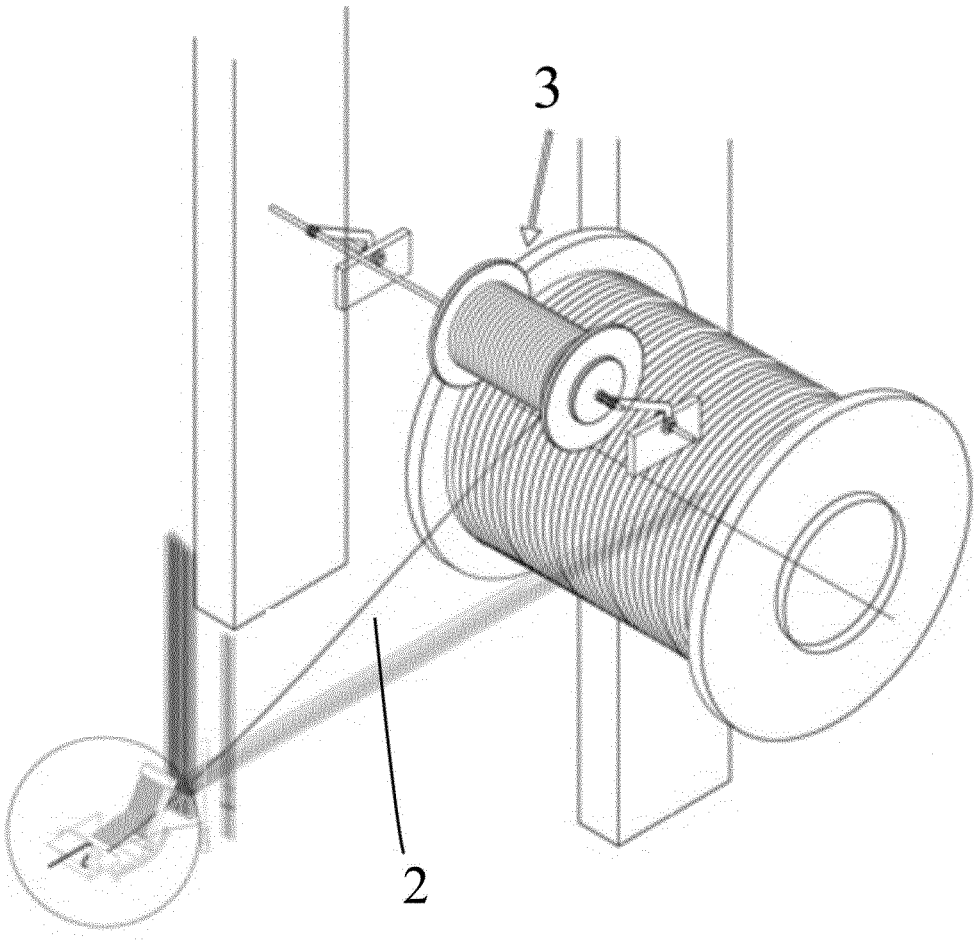
FIG. 7 shows a three-dimensional view of a loom known according to the current state of the art with the addition of a small beam (3)
Figure 8:
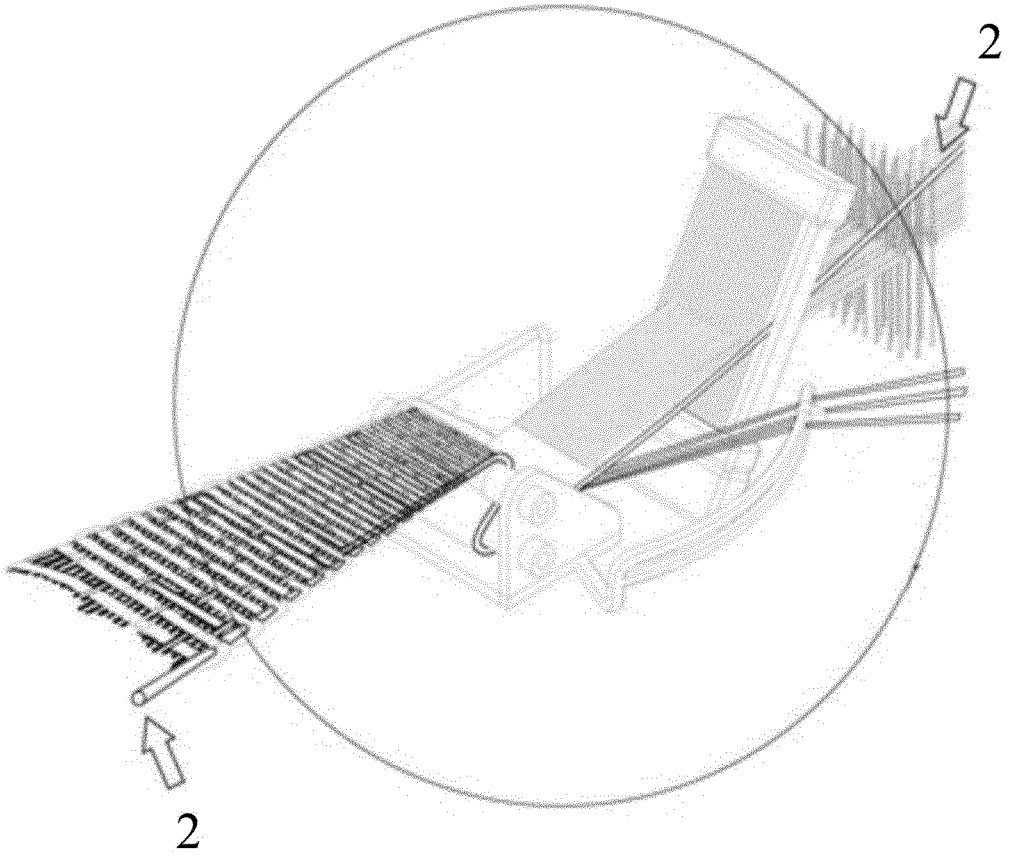
FIG. 8 shows a detail of FIG. 7 illustrating the passage of the cord (2) through the reed and is subsequently incorporated with the tubular technique into the woven tape.

This process is made possible by the insertion, during weaving, of a cord (2) to create a thickness on one side of the tape (FIG. 5), on which the zipper teeth can be fastened.

Insertion of the cord (2) during the weaving process is possible thanks to the addition of a small beam (3) to a jacquard loom known according to the current state of the art.

Without this alteration, necessary to weave the thick cord (2) into the tape, the product could not be used for zippers.

The looms with which it is possible to produce the tape with weft effect (1) that are the subject of this patent application, function in such a way that it is possible to insert wefts of different colours into the tape, unlike looms with warp effect which have a single weft.

Basically, the difference between a loom that weaves tapes with weft effect, i.e. using the jacquard method, rather than a loom that weaves tapes with warp effect using heddles or frames, is that with a jacquard looms it is possible to control each warp thread individually to form a fashion design with the insertion of many weft threads, unlike other looms which are limited by the number of heddles and by the single weft.

By design is meant:

a trademark a logo a frieze a motif wording a pattern a numerical representation any other design that can be woven on said tape using this method: jacquard zipper tape woven with weft effect.

In the multicoloured weft arrangement shown in FIG. 10, the weft thread (t) to be woven into the tape is raised by a heddle (z) and caught by an open pick (f) that inserts it into the tape, while weft threads (t1) and (t2) are not selected as not involved in the creation of the design in that section of tape and are therefore drawn downward by the heddle rods (z1) and (z2).

Figure 9:
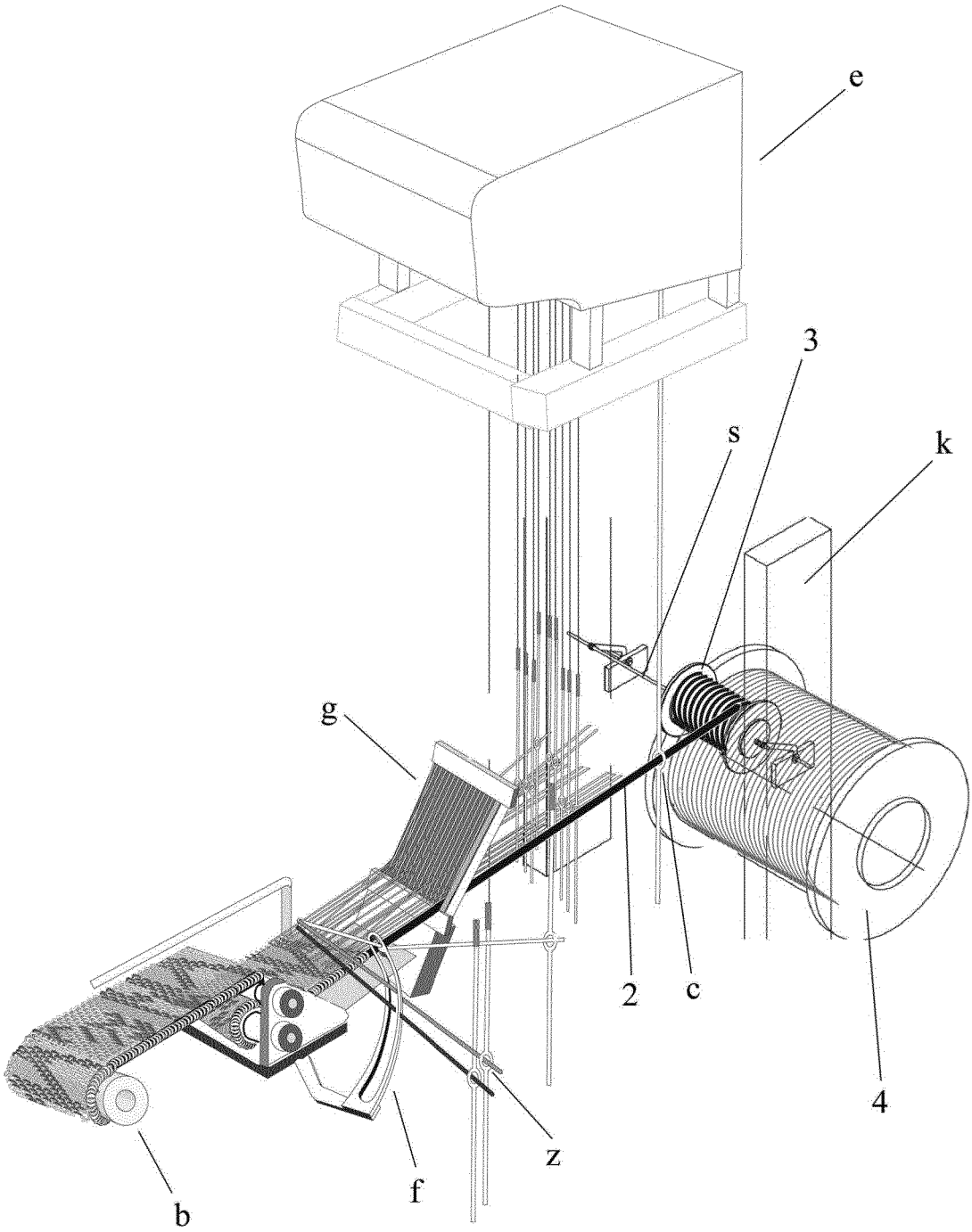
FIG. 9 shows a three-dimensional view of the jacquard loom for the production of a woven tape with weft effect illustrating.

FIG. 9 shows the working diagram for producing a woven tape with weft effect. The small beam (3) added to a jacquard loom known according to the current state of the art, containing the cord (2), is positioned in front of the main beam (4) and is supported by a rod (s) fastened to the uprights (k) of the jacquard loom.

The cord (2) is threaded through one of the heddles (c) whose movement, independently connected to the jacquard (e), is determined by this latter. Finally, said cord (2) passes through the reed (g) and is incorporated into the tape by tubular weaving. The draft of the tape with the cord (2) is controlled by the cloth roll (b).

The rate of unrolling the quantity of cord (2) is regulated by the pressure that the springs (m) and (ml) (visible in FIG. 12) exert on said small beam (3) and the intensity of the pressure is controlled by the screws (c) and (c1).

Figure 1:
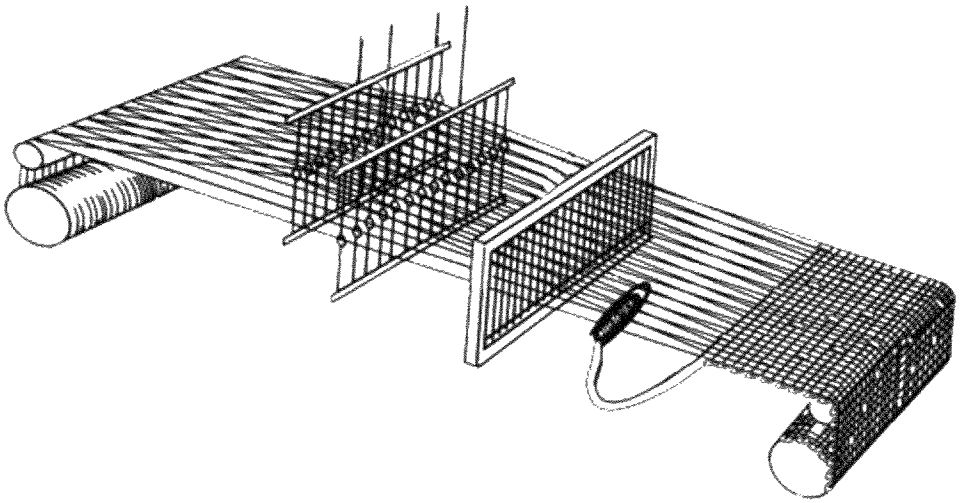
FIG. 1 shows a three-dimensional view of a shuttle loom known according to the current state of the art for weaving tapes with warp effect in which the warp threads are controlled by heddle frames or heddles that determine the processing of the tape.
Figure 2:
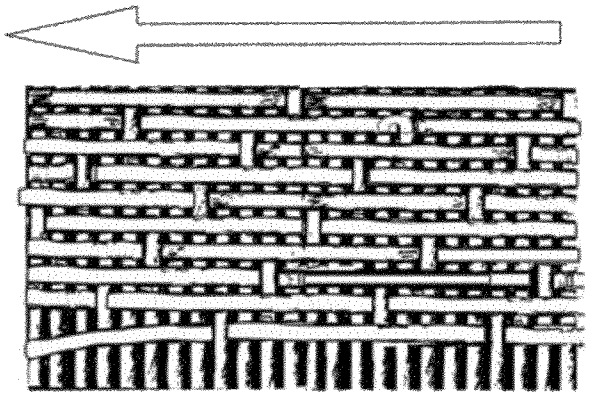
FIG. 2 shows, from the top, an example of weaving known according to the current state of the art, in which the warp threads are woven so as to create a design in the woven tape, and in which the arrow indicates the direction of output of the tape from the loom on which it is produced.
Figure 3:
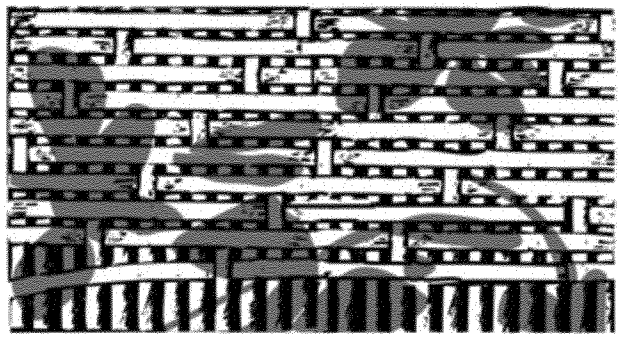
FIG. 3 shows, from the top, an example of weaving known according to the current state of the art, in which a tape woven with warp effect is printed with a design.
Figure 4:
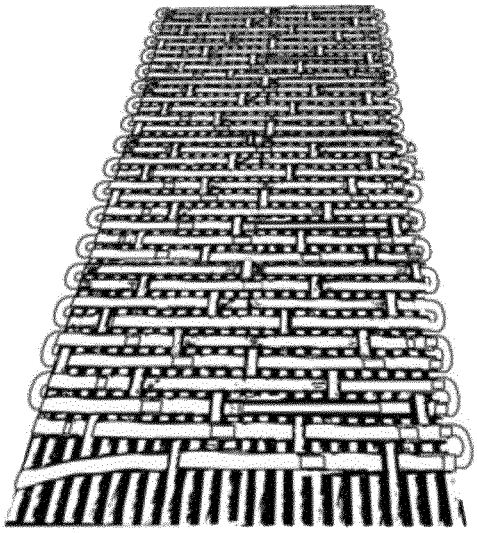
FIG. 4 shows a tape woven with weft effect known according to the current state of the art, in which the design motif is created mainly by the weft threads.

In FIG. 2 of document U.S. Pat. No. 2,424,411 A it can be seen how part of the tape adjacent to the tubular element is created with the warp threads (W) that unwind on the small beam (20) and have greater density and draft than the warp threads (W1) that unwind on the small beam (40). The different density and greater draft force the cord (C) shown in FIG. 3 toward the more tapered end (FIG. 2) of the conical rollers (50, 51 and 52) (FIG. 1), thereby fostering their torsion and above all the unrolling of the cord in the tape. Thus, it is sufficient to increase or decrease the weight (22) for a minimum adjustment of the unwinding of the beam (30) containing the cord (C).

The substantial difference between this invention and patent application U.S. Pat. No. 2,424,411 A is that in this invention the loom does not have two different beams (20, 40); the work is done by a single beam (4) (visible in FIGS. 9 and 12) which, considering the constant density and thickness of the warp threads, does not ensure the movement and control of the draft of the added beam (3) containing the cord (2) so that this latter can unwind correctly, making it possible to obtain a woven tape with weft effect usable for the production of zippers.

The weft is the arrangement of threads that are interlaced with those of a warp to form a fabric. In a process of weaving on a loom, the weft threads are those arranged horizontally, going from one selvage to the other, forming the design and covering the warp threads almost entirely. In this case the tape obtained is called "weft effect", where the design is mainly formed by the weft threads. In tapes produced with warp effect, the warp threads, which are worked mainly on the face of the fabric, produce the design.

In both types of loom, the warp threads are placed parallel lengthwise, and consist of many threads wound on the beam (a cylinder positioned behind the loom). These threads, after interlacing with the weft in the manner required by the design, are rolled on the cloth roller (a cylinder positioned in front of the loom).

If the loom weaves with warp effect, the individual threads of the warp are made to pass through the rings of the heddles. The heddles are vertical metal wires with an eye at the center, mounted on a frame called the heddle frame. The textile product obtained, limited in the development of the weft thread, is defined as "warp effect".

On looms that weave with weft effect, however, the threads that pass through the eyes are connected and controlled individually by the (e) and for the development of the weft of the fabric there are multiple possibilities for the creation of a design on the face of the fabric.

This technique is defined as "weft effect".

The fabric is formed by the interlacing of warp and weft threads: between the warp threads that are raised and lowered, an opening forms through which the shuttle, rapier or needle bearing the weft thread, is launched horizontally. In this way the weft thread is woven between the warp threads. When the shuttle, rapier or needle arrives at the end of its stroke, the heddles that were raised are lowered and the heddles that were lowered are raised and the shuttle returns through the new opening, making another insertion, and so on. After each passage of the shuttle, the reed tightens the weave with an alternating motion back and forth.

Repeating the same movements over and over, the fabric is produced and fed onto the cloth roll. Said cloth roll, in an alternative embodiment, may also be omitted, so that the fabric obtained can fall to the floor without being rolled.

In this patent application the small additional beam (3) is positioned behind the loom in front of the main beam (4) and contains the cord (2) which is threaded through one of the heddles where the threads of the rear beam (unrolling beam) pass, to allow it to unroll.

Simultaneously with the weaving process, in the space occupied by the cord (2) a tubular weave is produced to permit its insertion.

Said tubular weave is a double weave and is produced only in the space where the cord (2) is to be inserted. Said tubular weave is obtained by the construction of a double weave joined only longitudinally on the right and left so as to form an empty space in which said cord (2) can be inserted.

With the procedure that is the subject of this patent application, a woven tape with weft effect (1) is obtained for the production of zippers in which the design produced by the weft threads is sharp, clear and very well-defined. So that the zipper becomes an element of ornament capable of following the development of fashion and can reproduce an identifying mark such as a trademark or logo, even identical to that of the woven label and in any case univocally referring to a brand.

The materials and dimensions of the finding as described above, and illustrated in the enclosed drawings, and claimed hereafter, can be of any kind or type depending on the needs of the case. Moreover, all the details are replaceable with others that are technically equivalent, without thereby exceeding the scope of protection of this patent application.

The invention claimed is:

1. A process for producing a woven tape for a zipper with a weft effect by using a jacquard loom, the process comprising:

adding a heddle and a reed and a small beam to the jacquard loom, the small beam being positioned parallel to and in front of a main beam at a rear to the jacquard loom, the small beam being supported by a rod fastened to uprights of the jacquard loom;

positioning the heddle between the small beam and the reed such that a movement of the heddle is independently connected to the jacquard loom;

threading a cord of the small beam first through the heddle and then through the reed;

tubular weaving of the cord so as to incorporate the cord into the woven tape; and regulating the cord by a pressure of a pair of springs exerting on the small beam.

2. The process of claim 1, the step of tubular weaving comprising:

constructing a double weave so as to form a space into which the cord is inserted.

3. The process of claim 1, further comprising:

controlling the pressure on the cord by a pair of screws.

4. A woven tape obtained by the process of claim 1, wherein the cord is surrounded by threads of weft threads, wherein teeth of the zipper are fastened to the cord.

5. The woven tape of claim 4, wherein the zipper has a design created by the weft threads.

* * * * *